US009462401B2

(12) United States Patent
Müller et al.

(10) Patent No.: US 9,462,401 B2
(45) Date of Patent: Oct. 4, 2016

(54) METHOD FOR OPERATING A PUBLIC ADDRESS SYSTEM

(75) Inventors: Thomas Müller, Piesendorf (AT); Andreas Nejedly, Vienna (AT); Robert Reither, St. Pölten (AT); Josef Schreiner, Vienna (AT)

(73) Assignee: NOVAR GMBH, Neuss (DE)

( * ) Notice: Subject to any disclaimer, the term of this patent is extended or adjusted under 35 U.S.C. 154(b) by 396 days.

(21) Appl. No.: 13/877,618

(22) PCT Filed: Oct. 4, 2011

(86) PCT No.: PCT/EP2011/004937
§ 371 (c)(1),
(2), (4) Date: Oct. 17, 2013

(87) PCT Pub. No.: WO2012/045436
PCT Pub. Date: Apr. 12, 2012

(65) Prior Publication Data

US 2014/0029754 A1 Jan. 30, 2014

(30) Foreign Application Priority Data

Oct. 4, 2010 (DE) ..... 10 2010 047 220

(51) Int. Cl.
*H04R 29/00* (2006.01)
*H04R 27/00* (2006.01)

(52) U.S. Cl.
CPC ..... *H04R 29/007* (2013.01); *H04R 27/00* (2013.01)

(58) Field of Classification Search
CPC ..... H04R 29/007
USPC ..... 381/58
See application file for complete search history.

(56) References Cited

U.S. PATENT DOCUMENTS 4,404,548 A * 9/1983 Mueller ..... G08B 26/005 340/10.1
6,466,647 B1 * 10/2002 Tennyson ..... H04M 3/305 370/248

(Continued)

FOREIGN PATENT DOCUMENTS

EP 0 489 346 A2 6/1992
EP 0967833 A2 * 12/1999
EP 1 197 936 A2 4/2002

(Continued)

OTHER PUBLICATIONS

International Search Report for WO Application PCT/EP2011/004937.
EP examination report for corresponding EP application 11790863.2, in German, dated Jul. 29, 2015.

*Primary Examiner* — Sonia Gay
(74) *Attorney, Agent, or Firm* — Husch Blackwell LLP

(57) ABSTRACT

The invention relates to a method for operating a public address system with a control center to which loudspeakers are connected via a two-wire loop system that is routed via isolator modules. A fault can be located on the loop system if the control center measures the impedance of the loop system successively from isolator module to isolator module and the impedance of the entire loop system, inputs the measured values as target values into an impedance table, periodically measures the impedance of the entire loop system during operation, compares said impedance with the corresponding target value from the impedance table, generates a fault message upon determining a deviation, ascertains the fault location by comparing the measured value with the individual target values in the impedance table, and displays said fault location.

13 Claims, 3 Drawing Sheets

(56) References Cited

U.S. PATENT DOCUMENTS

| | | | |
|---|---|---|---|
| 2002/0057198 | A1 | 5/2002 | Ropke |
| 2010/0232080 | A1 | 9/2010 | Schermann et al. |

FOREIGN PATENT DOCUMENTS

| | | | |
|---|---|---|---|
| JP | 10-136493 | | 5/1998 |
| WO | WO 2008036992 | A2 * | 4/2008 |

* cited by examiner

METHOD FOR OPERATING A PUBLIC ADDRESS SYSTEM

The invention relates to a method for operating a public address system of the type specified in the preamble of claim 1.

Public address systems in public spaces frequently have an interface to an alarm system or form an integral part of the latter. At least when electroacoustic systems of this type are also used for announcing warnings, they are subject to great requirements placed on dependability. In particular, an interruption or a short circuit in the ring line supplying the loudspeakers must not result in failure of the entire system.

WO 2009/049949 A1 discloses the practice of accomplishing this dependability by routing the ring line via isolator modules, each of which comprises a switch or two switches in series, a microcontroller controlling the switch(es), an energy store that can be recharged from the ring line, and voltage checking circuits for an AC supply voltage delivered by the control center of the system. The AC supply voltage is at a frequency outside the audible range. These isolator modules allow the public address system to be operated using the method as claimed in the preamble of claim 1. To this end, the microcontroller periodically checks whether the incoming and outgoing line sections of the ring line are carrying the AC supply voltage. In the event of a voltage dip, the microcontroller—which, in that case, draws its operating voltage from the local energy store—opens the switch(es) in one of the looped-through wires of the ring line. If the voltage dip has been caused by a short circuit, the short circuit is isolated thereby. Whereas the control center feeds the audio signals and the AC supply voltage only into the start of the ring line during normal operation, the feed also needs to be provided from the end of the ring line in the event of a short circuit, in order to ensure that the two stubs that have arisen as a result of the separation of the short circuit are supplied with power. The means described in the above-identified document do not readily allow this design of stubs, however, because, after a short circuit, the switches on all of the isolator modules are open and, hence, the inputs and outputs of the isolator modules are at zero voltage and also do not communicate with one another in another way.

Irrespective of the above, the problem in such public address systems covering large areas with 60 or more loudspeakers is to be able to localize the fault location, that is to say, the interruption or the short circuit, on the ring line.

The invention is based on the object of providing a method of the type in question indicated above, which allows a fault as a result of interruption or short circuit on the ring line to be both found and localized in the control center. It is a further object to be able to easily start up the intact portions of the ring line again after a short circuit.

The invention achieves this object in that, when the ring line is started up, the control center measures the impedance of said ring line in steps from the first to the last isolator module and also the impedance of the whole ring line, enters the measured values into an impedance table as setpoint values, periodically measures the impedance of the whole ring line during operation, compares said impedance with the corresponding setpoint value from the impedance table, produces a fault report if a discrepancy is found, and ascertains and displays the fault location by comparing the measured value with the individual setpoint values in the impedance table.

Even installations that are already installed can have the above-identified functionality added with little outlay.

A fundamental prerequisite for the operation of the public address system being maintained without interruption in the event of an interruption in the ring line is that the control center feeds the AC supply voltage into the ring line both from the start and from the end of said ring line. At the same time, this is a prerequisite for restoration of the operability of the system following a short circuit, or, to be more precise, the operability of the stub that has arisen after separation of a short circuit, as a result, from the end of the previous ring line up to the area in front of the short circuit location.

A further improvement in the known method is that the control center performs the step-by-step measurement of the impedance of the ring line both from the start and from the end of said ring line, enters the measured values into two impedance tables, periodically measures the impedance of the ring line, likewise, both from the start and from the end of said ring line during operation, and, prior to producing a fault report and displaying the fault location, compares the measured actual values with the setpoint values in the two impedance tables.

The resultant redundancy increases the reliability of a fault report and, particularly, of the display of the correct fault location.

In order to allow the control center to reliably distinguish, particularly, even such isolator modules as have only short line sections between them and, hence, to greatly narrow down the fault location in the event of a fault, it is advantageous if the control center calculates the impedance values for the ring line at the frequency of the supply voltage by means of Fourier analysis.

When the ring line is started up, the impedance thereof can be measured in steps from the first to the last isolator module most easily if the switches on all of the isolator modules are first opened and then are sequentially closed in order to connect the ring line.

Preferably, the opening and sequential closing of the switches is performed both from the start to the end and from the end to the start of the ring line.

A simple way of separating a short circuit from the ring line is for, in the event of a short circuit, the switches on all of the isolator modules to be opened, then, beginning at the start and at the end of the ring line, sequentially closed again, and for the switches on the isolator modules to be immediately opened again directly on both sides of the short circuit location after closing.

Since, after a short circuit, the simultaneous reconstruction of the two stubs from the control center could result in the isolator module that is adjacent to the short circuit location in the stub that sets out from the start of the previous ring line closing its switch situated toward the short circuit location and, at the same time, any isolator module in the other stub, likewise, closing its switch situated on the short circuit location side and identifying this short circuit via the randomly likewise closed switches of the further isolator modules up to the short circuit location, said isolator module would open its switch again and leave it open. As a result, a substantial portion of this second stub could remain unoperational.

Preferably, the last isolator module at the end of the ring line, therefore, closes its switch(es) with a delay time that is longer than the time for sequentially closing the switches from the first to penultimate isolator modules.

So that the physical fault location can be found more easily for repair purposes, each isolator module may be equipped with an LED that the microprocessor switches on when the microcontroller has identified that such an isolator module is situated closest to the short circuit location and is, therefore, keeping the relevant switch permanently open.

The method according to the invention is explained below by way of example with reference to a public address system that is shown in highly simplified form in the drawings, in which.

Figure 1:
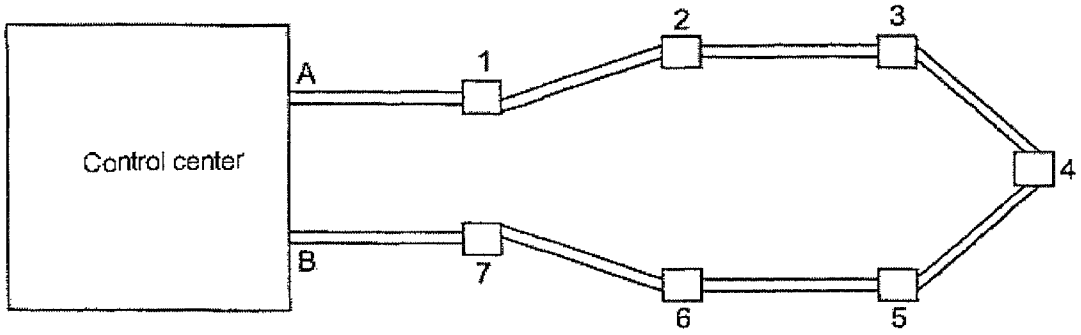
FIG. 1 shows the basic design of a public address system.

As FIG. 1 shows, a control center contains inherently known components, e.g. for a public address system, the control center has a connection A for the start of a two-wire ring line and a connection B for the end of the ring line. The wires of the ring line are looped through isolator modules 1 to 7. In practice, such a ring line may comprise 60 or more isolator modules. Loudspeakers—not shown here—are connected to the wires of the ring line in the isolator modules and/or to the line sections between the isolator modules. Usually, such systems involve the audio signals being supplied at up to 100 Vrms. In addition, the AC supply voltage supplied is a sine signal at 22 kHz with an amplitude of approximately 50 V, for example. Between the control center and the isolator modules and between the isolator modules themselves, there is no separate communication link, unlike in the case of alarm systems, e.g. fire alarm systems, which are designed using ring bus technology and have, on the ring bus, isolator modules that communicate digitally at least with the control center and are controlled by the latter.

Figure 2:
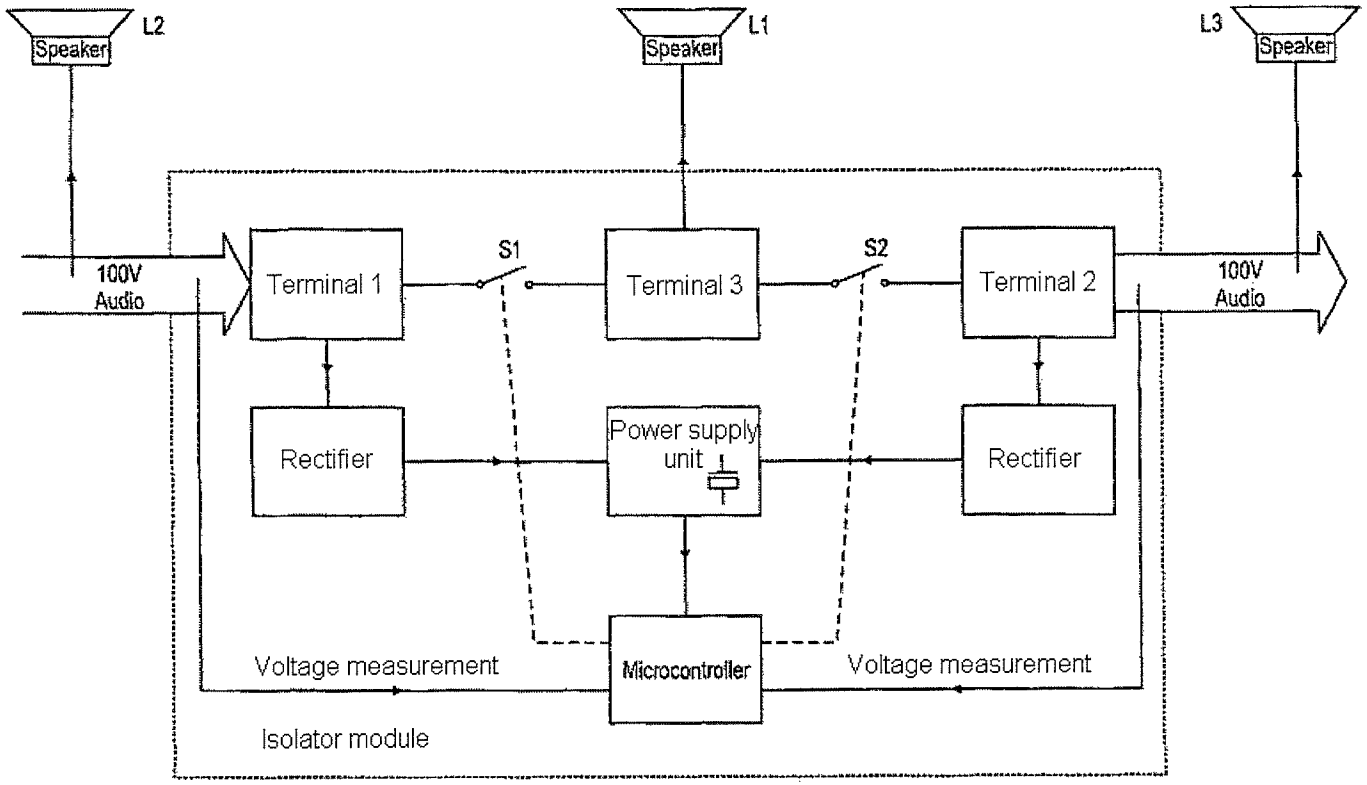
FIG. 2 shows a block diagram of an isolator module.

FIG. 2 shows a simplified block diagram of an isolator module, drawn with one pole. The terminal 1 has the incoming ring line connected to it, and the terminal 2 has the outgoing ring line connected to it. Two switches S1 and S2 are in series in a wire of the ring line that is looped through from terminal 1 to terminal 2. Between S1 and S2, there is a terminal 3 for connecting a loudspeaker L1. Further loudspeakers L2 and L3 may be connected to the ring line outside of the isolator module.

The switches S1 and S2 are, in this case, designed as contacts on separate relays—which are not shown here—both on account of the high audio voltages and on account of the high audio currents. The relays and, hence, the switches S1 and S2 are controlled by a microcontroller, specifically on the basis of whether there is an adequate voltage level at the input and/or at the output, or, to be more precise, whether a prescribed voltage level is exceeded or undershot. The separate voltage checking circuits, which are required for this purpose, are known and are, therefore, not shown.

The microcontroller receives its operating voltage from a power supply unit, which, itself, draws power both from the AC supply voltage that is applied to the input and from the AC supply voltage that is applied to the output via a respective rectifier during normal operation. However, the power supply unit additionally comprises an energy store in the form of a capacitor, which is, likewise, constantly charged from the AC supply voltage and via the rectifiers following voltage matching during normal operation. The capacitance of said capacitor is proportioned such that the isolator module can operate autonomously for a particular time, e.g. one to two seconds, in the event of the loss of the AC supply voltage (and the audio signals).

Figure 3:
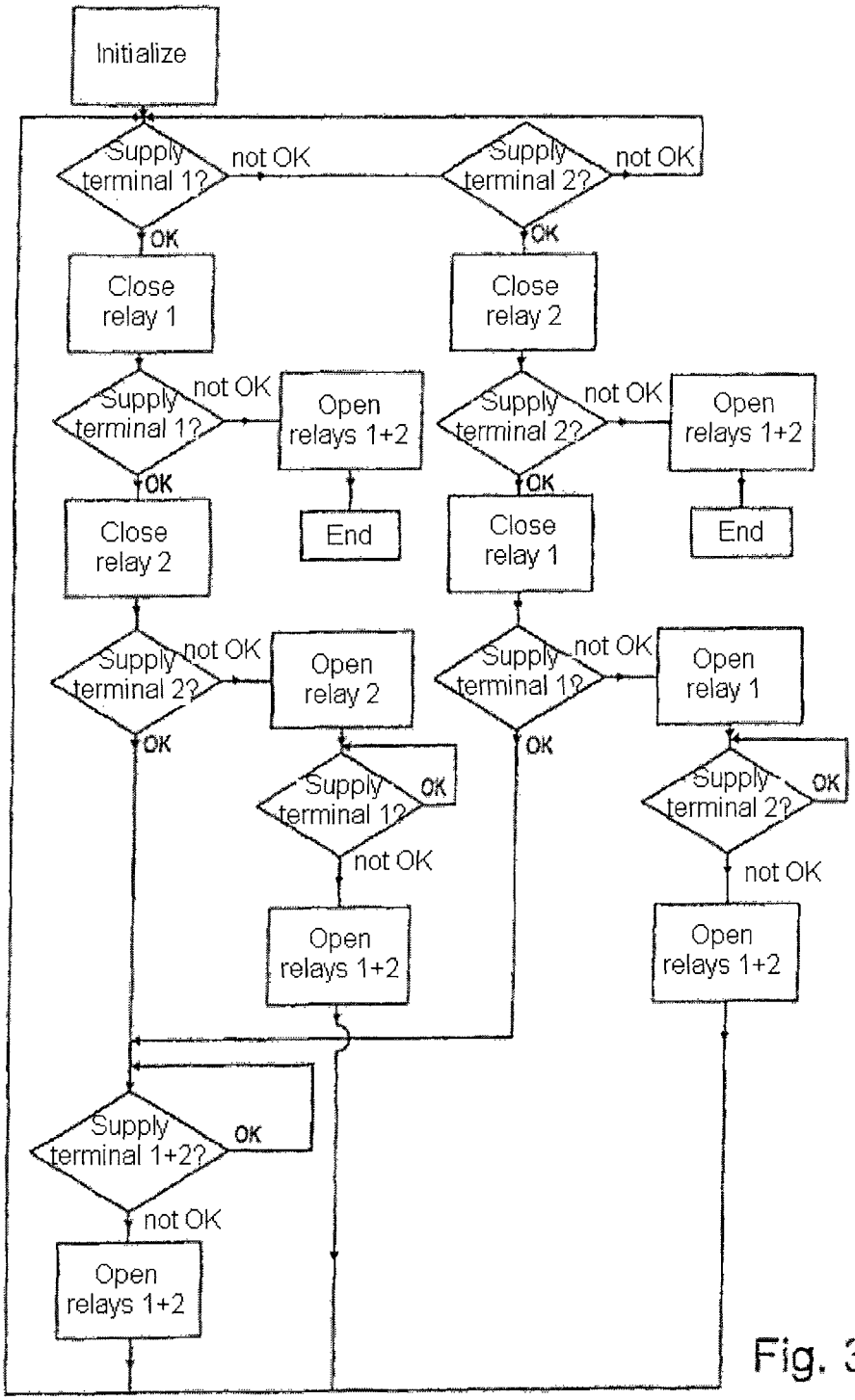
FIG. 3 shows a flowchart for the program execution in the microprocessor of the isolator module shown in FIG. 2.

FIG. 3 shows a simplified flowchart that illustrates the manner of operation of each of the isolator modules and, particularly, the routines and subroutines of the microcontroller, some of which are looped.

There now follows a description of the method for operating such a public address system.

When started up for the first time and after any alteration, e.g. in the number of isolator modules and/or in the loudspeakers, the ring line is calibrated. In the first step, the AC supply voltage is connected to the ring line and is then disconnected again. This ensures that all of the relays under the control of the microcontroller (see FIG. 3), have opened their switches S1 and S2 and, hence, a defined initial state is produced, which does not exist at first when bistable relays are used, for example.

In the next step, the control center applies the AC supply voltage again, but only to the start of the ring line, i.e. to the connection A. The microcontroller of the isolator module 1 identifies the presence of the supply voltage and, therefore, closes its switches S1 and S2 (denoted by "Relay 1" and "Relay 2" in FIG. 3). At the same time, the capacitor of its power supply unit is charged. During this, the control center measures the impedance of this first line section of the ring line at the frequency of the AC supply voltage and enters the measured value into a first field of an impedance table A as a setpoint value.

When the switch S2 of the first isolator module is closed, the second isolator module also receives the AC supply voltage. The control center identifies, from the sudden change of impedance that occurs when the switch S2 is closed, that the ring line is connected as far as this second isolator module. The control center repeats the impedance measurement and enters the new value into a second field of the impedance table A as a setpoint value for the impedance as far as the second isolator.

This calibration operation and the creation of a complete series of values in the impedance table A continues as far as the last isolator module. The control center can then measure the impedance of the whole ring line up to the end thereof at connection B and can also store this setpoint value. This measurement can also be performed at a later time.

In the next step, the control center disconnects the AC supply voltage from its connection A. As a result, the switches S1 and S2 of all of the isolator modules open again.

The control center then applies the AC supply voltage to its connection B and, hence, to the end of the ring line and repeats the calibration operation from the end to the start of the ring line. The relevant values are entered into an impedance table B by the control center.

In the last step, the control center applies the AC supply voltage both to its connection A and to its connection B. If it has not already done so, the control center measures the total impedance of the closed ring and stores the measured value as a setpoint value.

During operation, the control center periodically, e.g. every 5 to 10 seconds, measures the impedance of the ring line to which the AC supply voltage and, possibly, audio signals are fed from both ends, both from the connection A and from the connection B, and compares the measured values or actual values with the corresponding setpoint values in the impedance table A or the impedance table B.

In the event of an interruption in the ring line, the control center identifies this interruption from the fact that the measured values or actual values of the impedance differ from the corresponding setpoint values, and, therefore, generates a fault report. Furthermore, the control center compares the present measured values with the setpoint values that have been entered into the individual fields of the impedance tables A and B and uses the result to determine the number of the isolator module that, as seen from the connection A, is upstream of the interruption and the number of the isolator module that, in the same sense, is downstream of the interruption. The control center displays these isolator module numbers in a suitable form, i.e. on a display. The isolator modules are not involved in the identification of an interruption. Only the isolator modules that are closest to the interruption open their switch S1 or S2 that is situated on the interruption side in line with the flowchart in FIG. 3; however, this does not affect the two stubs that arise as a result of the interruption and/or the control center and the continued operation of the system.

In the event of a short circuit, the supply voltage on the isolator modules breaks down both at the input and at the output. As a result, the microcontroller, which is now supplied with its operating voltage autonomously from the capacitor, prompts the isolator module to put its relays, or, to be more precise, its switches S1 and S2, into the open position. This applies to all of the isolator modules. Only the isolator module 1 then receives its AC supply voltage via the connection A and closes its switches S1 and S2 in accordance with the program routine in FIG. 3. Next, the isolator module 2, therefore, likewise receives the AC supply voltage and closes its switches S1 and S2, etc., up to that isolator module that is closest to the short circuit location. The microcontroller of this isolator module, after its switch S2 has closed, establishes that the AC supply voltage breaks down, and, therefore, immediately opens the switch S2 again and keeps the switch S2 permanently open because the breakdown in the AC supply voltage in the case of this sequence of switching operations indicates that the relevant isolator module is immediately adjacent to the short circuit location. The switches S1, S2 of the further isolator modules, which are situated between this isolator module and the connection A of the control center, remain closed, on the other hand, because the short circuit did not occur immediately after their respective relays or switches closed. Therefore, the stub from the connection A to the last isolator module upstream of the short circuit location is restored and all of the connected loudspeakers are operational again.

Next, above-described cycle is repeated starting from the connection B and the last isolator module, that is to say, the isolator module 7 in the example in FIG. 1.

However, this last isolator module begins closing its switches S1 and S2 only with a time delay, which is proportioned such that, by then, the setup of the longest possible stub starting from the connection A, that is to say, up to the isolator module 6 in FIG. 1, is certain to be complete. This delay time may be three seconds for 60 isolator modules, for example. The reason is that if, in the example in FIG. 1, the isolator modules 1 and 7 were to begin to set up their respective stubs simultaneously, then the situation could arise in which, when the last isolator module of the first stub closes its switch S2 and, hence, connects "into" the short circuit, one of the isolator modules in the second stub simultaneously, likewise, closes its switches (even if this is not the isolator module that is immediately adjacent to the short circuit), hence, likewise intends to connect "into" the short circuit and would, therefore, open its switches again and leave them open, even though this isolator module is not the isolator module that is closest to the short circuit location. Depending on the position of the short circuit location in relation to this erroneously switching isolator module, a large portion of the ring or of the second stub would then remain permanently unoperational.

Following the separation of the short circuit and the setup of the two stubs as far as the short circuit location, the stubs as seen from the control center behave as in the case of an interruption in the ring line. The control center, therefore, ascertains the numbers of the respective last isolator modules upstream of the short circuit location during the next impedance measurement in the same manner as in the case of an interruption.

If all of the isolator modules are equipped with an LED, then the microcontroller of the isolator modules that are respectively adjacent to the short circuit location can actuate the LEDs of said isolator modules in order to make it easier to find the physical short circuit location.

The invention claimed is:

1. A method of operating a public address system having a plurality of loudspeakers, the method comprising:

providing control circuitry;

coupling each of the plurality of loudspeakers to the control circuitry via a two-wire loop that includes isolator modules;

determining values of an impedance of the two-wire loop successively from isolator module to isolator module by successively connecting each respective isolator module of the plurality of loudspeakers to the two-wire loop proceeding from a start to an end of the two-wire loop while repeating an impedance measurement from the start of the two-wire loop after each successive connection;

determining a value of an impedance of the entire two-wire loop;

storing at least some of the determined values of the impedance of the two-wire loop successively from isolator module to isolator module and the determined value of the impedance of the entire two-wire loop as target values;

intermittently determining the value of the impedance of the entire two-wire loop during operation; and determining if a variance exists between the determined value of the impedance of the entire two-wire loop during operation and the stored target values, and, responsive thereto, generating a fault message including a fault location.

2. A method as in claim 1 which includes comparing a measured impedance value with a corresponding one of the target values.

3. A method as in claim 1 which includes locating a fault in the two-wire loop.

4. A method as in claim 3 wherein locating includes comparing the determined values of the impedance of the two-wire loop successively from isolator module to isolator module with the stored target values and displaying the fault location.

5. A method as in claim 4 which includes storing the target values in an impedance table.

6. A method as in claim 3 which includes using Fourier analysis to determine the values of the impedance of the two-wire loop successively from isolator module to isolator module, to determine the value of the impedance of the entire two-wire loop, or to determine the value of the impedance of the entire two-wire loop during operation.

7. A method as in claim 2 which includes providing switches between the isolator modules, and opening and closing the switches to switch the two-wire loop sequentially.

8. An apparatus comprising:

a plurality of loudspeakers, wherein each of the plurality of loudspeakers is coupled to control circuitry via a two-wire loop that includes an isolator module per loudspeaker, wherein the control circuitry measures values of an impedance of the two-wire loop successively from isolator module to isolator module by successively connecting each respective isolator module of the plurality of loudspeakers to the two-wire loop proceeding from a start to an end of the two-wire loop while repeating an impedance measurement from the start of the two-wire loop after each successive connection, wherein the control circuitry measures a value of an impedance of the entire two-wire loop, wherein the control circuitry stores at least some of the measured values of the impedance of the two-wire loop successively from isolator module to isolator module and the measured value of the impedance of the entire two-wire loop as target values, wherein the control circuitry periodically measures the value of the impedance of the entire two-wire loop during operation, and wherein the control circuitry compares the measured value of the impedance of the entire two-wire loop during operation with the stored target values, and, in a presence of a variance between the measured value of the impedance of the entire two-wire loop during operation and the stored target values, generates a fault message.

9. An apparatus as in claim 8 wherein the control circuitry stores at least some of the measured values of the impedance of the two-wire loop successively from isolator module to isolator module and the measured value of the impedance of the entire two-wire loop as target values in an impedance table.

10. An apparatus as in claim 8 which includes a display coupled to the control circuitry, wherein the control circuitry presents a fault location on the display.

11. An apparatus as in claim 8 wherein the control circuitry open circuits switches to isolate each respective isolator module from one another, and, to locate a short circuit, sequentially closes the switches.

12. An apparatus as in claim 8 wherein each respective isolator module includes first and second isolator switches coupled to the control circuitry.

13. An apparatus as in claim 12 which includes a power supply that is activated by electrical energy from the two-wire loop.

* * * * *